United States Patent [19]

Pehrson

[11] Patent Number: 4,524,836

[45] Date of Patent: Jun. 25, 1985

[54] SCRAPER WITH DUAL-DIRECTION BLADE TILT CONTROL

[75] Inventor: John V. Pehrson, Sparks, Nev.

[73] Assignee: Reno Energy Systems, Inc., Sparks, Nev.

[21] Appl. No.: 500,891

[22] Filed: Jun. 3, 1983

[51] Int. Cl.[3] ..... E02F 3/76; E02F 3/85

[52] U.S. Cl. ..... 172/4.5; 318/649

[58] Field of Search ..... 172/2, 4.5, 797; 404/84, 96; 318/648, 649, 587

[56] References Cited

U.S. PATENT DOCUMENTS

| | | | |
|---|---|---|---|
| 3,182,410 | 5/1965 | Schiavi | 404/96 X |
| 3,602,113 | 8/1971 | Davin et al. | 404/84 |
| 4,120,364 | 10/1978 | Wooldridge | 172/2 |
| 4,156,466 | 5/1979 | Caldwell | 172/4.5 |
| 4,162,708 | 7/1979 | Johnson | 172/4.5 |
| 4,247,809 | 1/1981 | Nessel | 318/649 X |

*Primary Examiner*—Richard T. Stouffer
*Attorney, Agent, or Firm*—Julian Caplan

[57] ABSTRACT

The control is mounted on the turntable of a conventional motor grader or similar scraper, in a direction parallel to an axis through the points of attachment to the turntable of the rods of two rams which control the angle of the blade of the scraper to the horizontal. The control is used to hold the blade angle at a first angle when the scraper is moving in one direction and at a second angle when moving in another direction. In the control are two vials mounted side-by-side and adjustable by a motor to be centered at the aforesaid first and second angles. A control box on the cab enables the operator to selectively adjust the electric current of the device to respond to one vial or the other depending on the direction of movement of the scraper. If the blade is off the desired angle, a signal from the vial actuates a hydraulic valve control to energize one or both rams to raise or lower and thus restore the blade to the preselected angle. When the scraper moves in a different direction, the operator switches the control box to bring into the circuit the other vial.

6 Claims, 5 Drawing Figures

SCRAPER WITH DUAL-DIRECTION BLADE TILT CONTROL

This invention relates to a new and improved dual-direction control for blade leveller, such as a motor grader or similar scrapers used in road construction and repair, levelling fields and for many other purposes. Frequently, such equipment proceeds in one direction with the blade adjusted at a certain angle to the horizontal and returns in the opposite direction with the blade adjusted to a different angle relative to the horizontal. A typical example of such usage is in grading a crowned roadbed. In accordance with the present invention, an instrument mounted on the turntable of the scraper is electrically set to control the blade to remain at the first angle when going in the first direction and separately electrically set to maintain the blade at the second angle when the scraper is moving in the second direction. A switch controlled by the operator switches the electrical system from one setting to the other and an electric-hydraulic control automatically holds the blade at the proper angle.

Accordingly, the present invention provides an automatic control of the level of a blade to allow a calibrated tilt of the blade at a first angle when moving in a first direction and at a second angle when moving in a second direction by elevating one side of the blade or the other to a given tilt.

Two commercially available electric sensing levelling vials are mounted side by side in an enclosure mounted on the blade turntable (and hence mounted at the same slope as the blade itself). Such vials produce electrical signals when tilted from the horizontal. Both vials are adjusted simultaneously so that it will be disposed horizontally when the blade itself is at a predetermined angle of tilt, which angle is electrically or otherwise set prior to commencement of operation. The adjustments are very fine—if desired, up to 1/10th foot per hundred feet. A digital display readout indicates the angle of tilt.

Means is also provided in accordance with the invention for overriding the automatic control when such override is required.

A control box is mounted in the cab of the grader, convenient to the operator, containing signal lights indicating whether the blade is on or off the desired tilt, which of the two vials is connected into the electric circuit and also containing switches to switch from one vial to the other and override the automatic control. A center green light indicates that the blade is at the proper tilt. Amber signal lights on either side of the green light indicate when the high end of the blade is too high or too low.

Other objects of the present invention will become apparent upon reading the following specification and referring to the accompanying drawings in which similar characters of reference represent corresponding parts in each of the several views.

Figure 1:
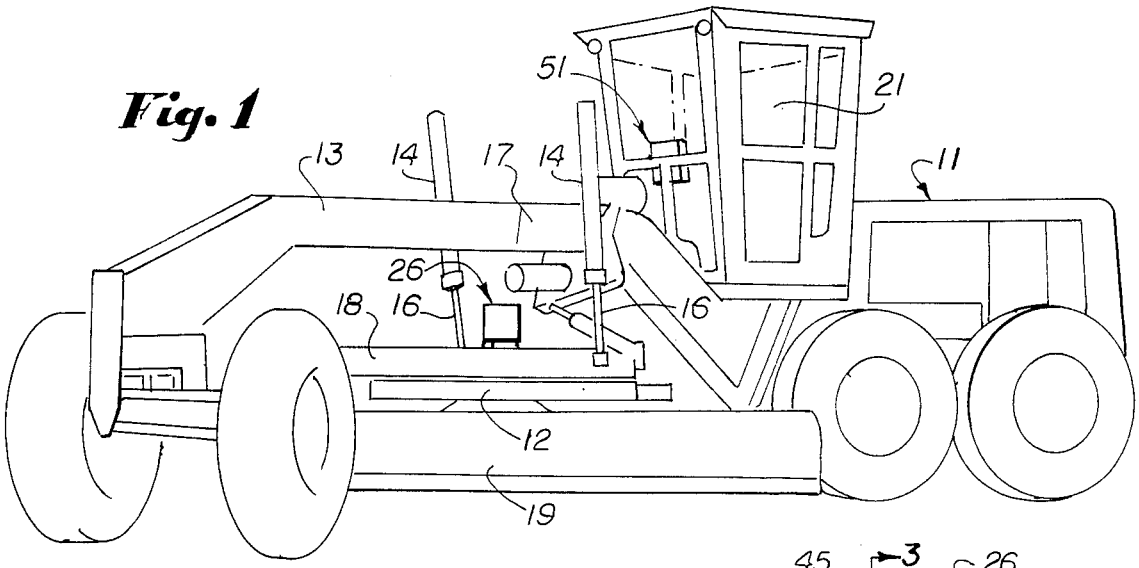
FIG. 1 is a schematic perspective view of a motor grader of conventional type showing the present device installed thereon.

Motor grader 11, herein illustrated, is merely representative of a wide variety of graders in which the present device may be installed. The particular grader schematically illustrated is the Model 14G Caterpillar Motor Grader. Details of the grader are thought not necessary to an understanding of the present invention. The grader has a turntable 12 which oscillates and tilts below an arch 13. A a pair of hydraulic ram cylinders 14 having rods 16, are mounted on support arms 17 extending out from the arch 13. The rods 16 are articulately connected to turntable 12. Connector 18 supports the turntable 12 from the forward end of arch 13. Mounted below turntable 12 is a scraper blade 19 which oscillates relative to the turntable. By adjustment of the rams 14, the angle of the turntable 12 and hence the blade 19 are adjusted. Such adjustments, as well as steering of the grader, are performed by the operator in the cab 21.

Figure 3:
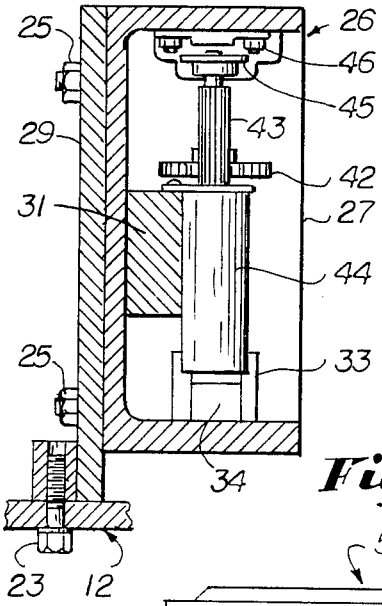
FIG. 3 is a sectional view taken substantially along the line 3—3 of FIG. 2.
Figure 2:
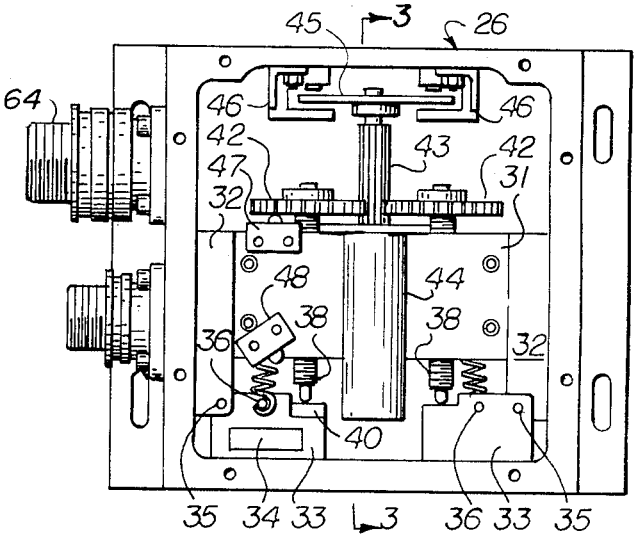
FIG. 2 is a front elevational view of the blade control assembly with the cover plate removed and with portions broken away to reveal internal construction.
Figure 4:
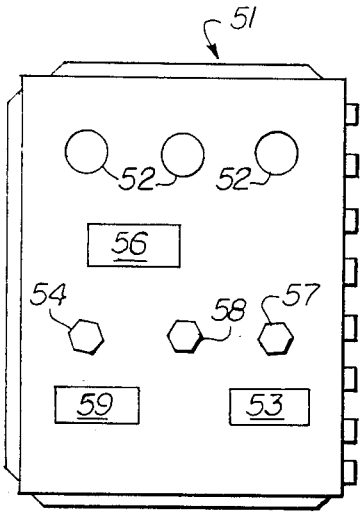
FIG. 4 is a front elevational view of the control box mounted on the cab.
Figure 5:
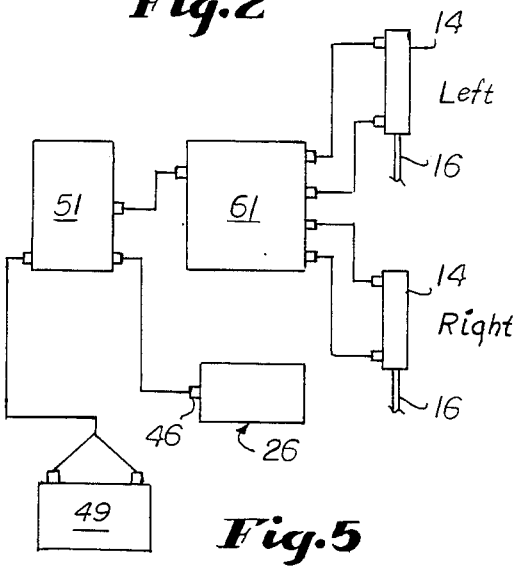
FIG. 5 is a schematic diagram of the device.

Secured to the turntable 12, preferably on the axis between the points of connection of the rods 16 to the turntable 12, is blade control assembly 26, shown in detail in FIGS. 2 and 3. The assembly 26 has a rectangular box-like enclosure 27 which is provided with a removable cover (not shown). A backing plate 29 is secured (as by a bolt 23 and welding 24) to the turntable 12 in vertical position and the enclosure 27 is secured to the backing plate 29 by bolts 25. Extending transversely through and secured to the enclosure 27 is a center block 31 on which other elements of the blade control are mounted. Depending from either end of center block 31 is a support 32 to which is pivotally attached a generally U-shaped cross-section vial rail 33 by means of pivot 35. Thus the vial rail 33 may be angularly adjusted relative to the center block 31 as hereinafter appears.

Mounted within the vial rail 33 is a vial enclosure 34 in which is a vial (not shown). One suitable vial is manufactured by Fredericks Co. and a particular suitable vial is Model No. 101-107-19(9-0701-2030.99). The vial is a closed capsule containing an electrically conductive liquid which substantially, but not completely, fills the capsule. Electrical wires are connected to the center and either end of the vial. The function of the vial is that, when it is tilted from the horizontal toward either end, an electric signal is emitted therefrom, which signal is used to control the grader 11 as hereinafter explained.

Vial rail 33 and hence the vial are adjusted relative to center block 31 by turning adjustment screw 38 which engages a pad 40 on rail 33. Each screw 38 is threaded through center block 31 and is turned by gear 42 on the upper end thereof. The pad 40 is biased into contact with the bottom of the adjustment screw 38 by spring 37 fixed at its upper end to center block 31 and dowel 36. Dowel 36 is fixed to center block 31 and the spring 37 which surrounds the dial is a tension spring tending to lift rail 33 toward center block 31 and hence maintain the pad 40 in contact with the lower end of screw 38.

Gears 42 mesh with an elongated pinion 43 turned by reversible motor 44 which fits into a cavity in center block 31.

Pinion 43 at its upper end carries an elongated horizontal vane 45 which has a lobe at either end positioned to interrupt magentic flux in Hall effect sensors 46 fixed to the top of enclosure 27 at either side. A suitable sensor is made by Micro Switch Division of Honeywell Corp., Model PK 8757-1. Hence, as motor 44 turns, vane 45 revolves and affects sensors 46 in sequence, indicating the number of revolutions of screws 38 and hence tilt of the vials in rails 33. Limit switch 47 stops downward movement of one gear 42. Limit switch 48 stops upward movement of one vial rail 33.

The electrical connections to and from the two vials extend out of the enclosure 27 through electrical connector 64. Current for the electrical system of the vials may be furnished by battery 49 which may be the conventional battery on the grader 11 or a separate battery.

Mounted in the cab 21 adjacent the operator's seat is a control box 51. Exposed on the cover of control box 51 are three lights 52, the center light of which is green (indicating that the blade 19 is at the desired angle) and the amber lights 52 at either end of the green light indicating whether the high end of blade 19 is too high or too low. A digital read-out 56 such as liquid cyrstal display AND #FE 0201E indicates percept of grade + or −.

Also mounted on the cover of control box 51 is a double switch 53 which connects either the left vial or the right vial and sensors 46 into the control system.

Double throw switch 54 may be used to adjust the level of blade 19 manually and the setting is locked by switch 58. When necessary, this control of the blade may be manually overridden by switch 57.

In a preferred installation the blade is automatically controlled but the automatic control may be turned off or on by switch 59.

The hydraulic module 61 is electrically connected to the control box 51 and operates hydraulic valves which raise or lower one of the rods 16 of one of the rams 14. It is preferable to raise or lower only one ram, rather than both. A suitable module 61 is a pressure-compensated proportional output hydraulic valve such as Dynex/Rivett Segmented Valve consisting of pressure-compensated assembly #51509000, Closed Segment #51729000, right-hand Outlet Section #32879000, Tie-Rod Kit #52839000 and Proportional Valve Segment #52329000.

In operation, the operator ordinarily uses the override switch 57 to raise the scraper blade 19 to bring the grader 11 to the point of use. Thereupon, the operator adjusts switch 54 to set the left and right vials at the desired grade, observing the setting through the display 56 and setting by switch 56. Such adjustment causes the hydraulic controls in the module 61 to raise one end of the blade 19 by energizing one of the rams 14 until the particular vial in use reaches horizontal position, whereupon the ram 14 remains stationary. Assuming that the device is being used in grading a crowned road, the operator steers the grader 11 along the road in one direction and blade 19 grades the road at the proper slope. When the grader reaches the end of its path of travel, the operator operates the override switch 57 to raise the blade 19 out of the way and then turns the grader in the opposite direction. Thereupon, the switch 53 is thrown to the opposite direction bringing the other vial into the electrical circuit.

During movement in either direction, any tendency of the blade 19 to tilt out of proper angle is automatically controlled through the control box 51 and the module 61.

What is claimed is:

1. In combination, a scraper or the type having a frame, a turntable articulately supported by said frame, a scraper blade depending from said turntable, at least one ram interconnecting said frame and said turntable to adjust the tilt of said blade relative to said frame, and a blade tilt control, said control comprising an enclosure, means for mounting said enclosure on said turntable, a first vial rail, first mounting means pivotally mounting said first vial rail in said enclosure about an axis parallel to said turntable, a second vial rail, second mounting means pivotally mounting said second vial rail in said enclosure about an axis parallel to said turntable, first adjustment means for adjusting the tilt of said first vial rail relative to said enclosure, second adjustment means for adjusting the tilt of said second vial rail relative to said enclosure, first and second vials fixed in said first and second vial rails respectively, each said vial being of a type emitting a first signal when tilted off horizontal in a first direction and a second signal when tilted off horizontal in a second direction, an electric circuit connected to said vials having a switch to selectively include one or the other of said vials into said circuit, and electrical means to control energization of said ram in either direction responsive to signals emitted from the particular vial connected into said circuit by said switch.

2. A combination according to claim 1 in which each said adjustment means comprises a nut fixed to said enclosure, a screw threaded into said nut, said screw bearing against one said rail, resilient means biasing said rail against said screw, and a motor for turning said screw.

3. A combination according to claim 2 which further comprises indicator means connected to said screw indicating tilt angle of said vial rail relative to said enclosure and means for driving said indicator means dependent upon turning of said motor.

4. A combination according to claim 1 in which said electric circuit includes three signal lights, said lights being controlled by the particular vial connected into said circuit by said switch, one said light being illuminated when the vial in said circuit is level and the other two lights being illuminated when said vial is off horizontal in one direction or the other.

5. A combination according to claim 1 in which said electric circuit includes an override switch to control said ram independent of said vials.

6. A combination according to claim 1 which further comprises a source of hydraulic pressure, a valve to direct pressure to either end of said ram and an electric control for said valve.

* * * * *